US008590719B2

(12) United States Patent
Sprishen et al.

(10) Patent No.: US 8,590,719 B2
(45) Date of Patent: Nov. 26, 2013

(54) TWO PIECE CHILD RESISTANT CLOSURE THAT IS EASY TO OPEN AND/OR MANUFACTURE

(75) Inventors: Gregory Sprishen, Newtown Square, PA (US); William Gordon Knestrick, III, Macungie, PA (US)

(73) Assignee: Drug Plastics & Glass Company, Inc., Boyertown, PA (US)

( * ) Notice: Subject to any disclaimer, the term of this patent is extended or adjusted under 35 U.S.C. 154(b) by 360 days.

(21) Appl. No.: 12/912,881

(22) Filed: Oct. 27, 2010

(65) Prior Publication Data

US 2011/0094990 A1 Apr. 28, 2011

Related U.S. Application Data

(60) Provisional application No. 61/255,198, filed on Oct. 27, 2009.

(51) Int. Cl.
*B65D 55/02* (2006.01)
*B65D 41/04* (2006.01)

(52) U.S. Cl.
USPC ..... 215/216; 215/330; 215/334

(58) Field of Classification Search
USPC ..... 215/216, 330, 334, 227, 204, 230, 305, 215/277
See application file for complete search history.

(56) References Cited

U.S. PATENT DOCUMENTS

| | | | | |
|---|---|---|---|---|
| 3,027,035 | A | 3/1962 | Farago | |
| 3,822,805 | A | 7/1974 | Marchant | |
| 3,888,375 | A * | 6/1975 | Gerk | 215/219 |
| 3,892,325 | A | 7/1975 | Maguire | |
| 3,934,744 | A | 1/1976 | Curry | |
| 3,977,557 | A | 8/1976 | Hazard | |
| 4,002,258 | A | 1/1977 | Curry | |
| 5,197,616 | A | 3/1993 | Buono | |
| 6,357,615 | B1 | 3/2002 | Herr | |
| 7,111,746 | B2 | 9/2006 | Miceli et al. | |

* cited by examiner

*Primary Examiner* — J. Gregory Pickett
*Assistant Examiner* — Ernesto Grano
(74) *Attorney, Agent, or Firm* — Panitch Schwarze Belisario & Nadel LLP

(57) ABSTRACT

A closure includes a cup shaped overcap having a depending sidewall. The sidewall is provided with a lug having a plurality of inwardly facing teeth. Each one of the inwardly facing teeth has a gently sloping face and steeply sloping face. The slopes of the gently sloping faces and the steeply sloping faces of at least two of the inwardly facing teeth differ respectively one from another. The closure also includes a cup shaped undercap having a depending sidewall. The sidewall is provided with a plurality of outwardly facing teeth around its periphery. Each one of the teeth has a steeply sloping face and a gently sloping face. The steeply sloping faces and the gently sloping faces of the outwardly facing teeth are adapted to abut respectively, at least two of the steeply sloping faces and the gently sloping faces of the inwardly facing teeth.

12 Claims, 5 Drawing Sheets

TWO PIECE CHILD RESISTANT CLOSURE THAT IS EASY TO OPEN AND/OR MANUFACTURE

CROSS-REFERENCE TO RELATED APPLICATIONS

This application claims the benefit of U.S. Provisional Application No. 61/255,198, filed Oct. 27, 2009, the contents of which are incorporated herein by reference in their entirety.

BACKGROUND OF THE INVENTION

Field of Invention

This invention relates to container closures and more particularly to a child resistant closure.

Child resistant closures should make it difficult for a child to open a container but easy for an adult to open. Also, a child resistant closure should be capable of being attached to a container by automatic container filling and capping machines and amenable to shrink banding and induction heating.

Two known types of child resistant closures for screw type container finishes are referred to as "push and turn" and "squeeze and turn". The former type requires the user to push down on the closure in order to remove the closure from the container. The latter requires the sides of the closure to be squeezed in order to remove the closure from the container.

Push and turn closures generally include an outer cap and in inner cap. The inner cap is free rotate and to move vertically within the outer cap. Push and turn closures are known to cause problems in filling lines due to overall height variations of the closure. Also, many prior art squeeze and turn closures require mating lugs to be integrated with the container finish. Such containers are not compatible with Society of Plastics Industry (SPI) standard finishes.

There is a need for a child resistant closure which has a fixed gap between the inner and the outer cap in order that jamming of the closure is to be avoided during the container filling process. Also, there is a need for a child resistant closure which is compliant with SPI continuous thread neck finishes.

BRIEF SUMMARY OF THE INVENTION

A preferred embodiment of a closure comprises a cup shaped overcap having a top wall and a depending sidewall, said sidewall being provided with a lug having a plurality of inwardly facing teeth, each one of the plurality of inwardly facing teeth having a gently sloping face and steeply sloping face, the slopes of the gently sloping faces and the steeply sloping faces of at least two of the plurality of inwardly facing teeth differing respectively one from another; and a cup shaped undercap having a top wall and depending sidewall, said sidewall being provided with a plurality of outwardly facing teeth around its periphery, each one of the teeth having a steeply sloping face and a gently sloping face, the gently sloping face extending generally in a counter-clockwise direction when viewed from the top wall of the undercap, said undercap being rotatably fit and axially fixed in the interior of the overcap, the steeply sloping faces and the gently sloping faces of the outwardly facing teeth being adapted to abut respectively, at least two of the steeply sloping faces and the gently sloping faces of the inwardly facing teeth.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
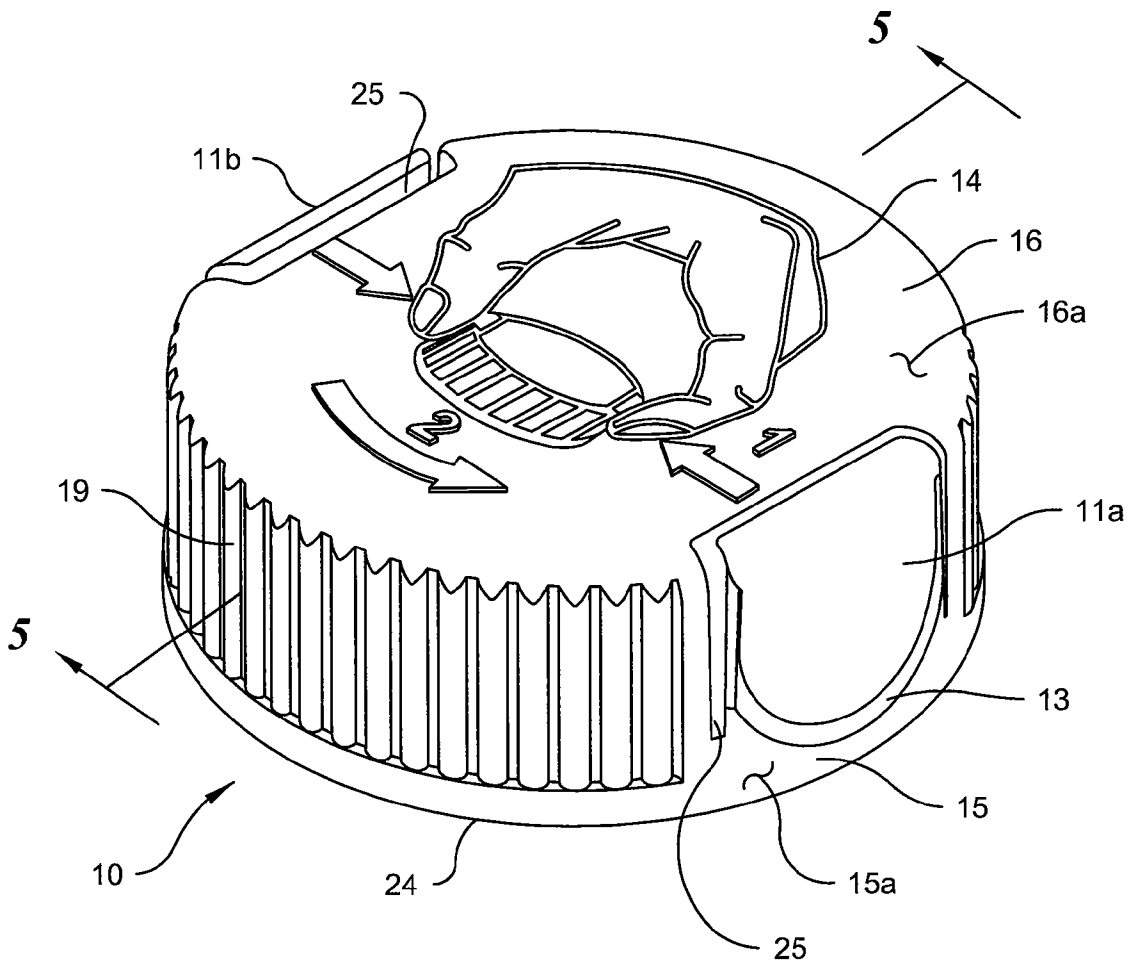
FIG. 1 is a perspective top view of an overcap in accordance with a preferred embodiment of a child resistant closure showing lugs.

Certain terminology is used in the following description for convenience only and is not limiting. The words "right", "left", "lower" and "upper" designate directions in the drawings to which reference is made. The words "inwardly" and "outwardly" refer to lateral directions toward and away from, respectively, the geometric center of the closure and designated parts thereof. The terminology includes the above-listed words, derivatives thereof and words of similar import.

Referring now to the drawings in detail, wherein like numerals are used to indicate like elements throughout, there is shown in FIGS. 1-6 a presently preferred embodiment of a child resistant closure, generally designated 1, for use with a container having a standard Society of Plastics Industry (SPI) finish.

Figure 4:
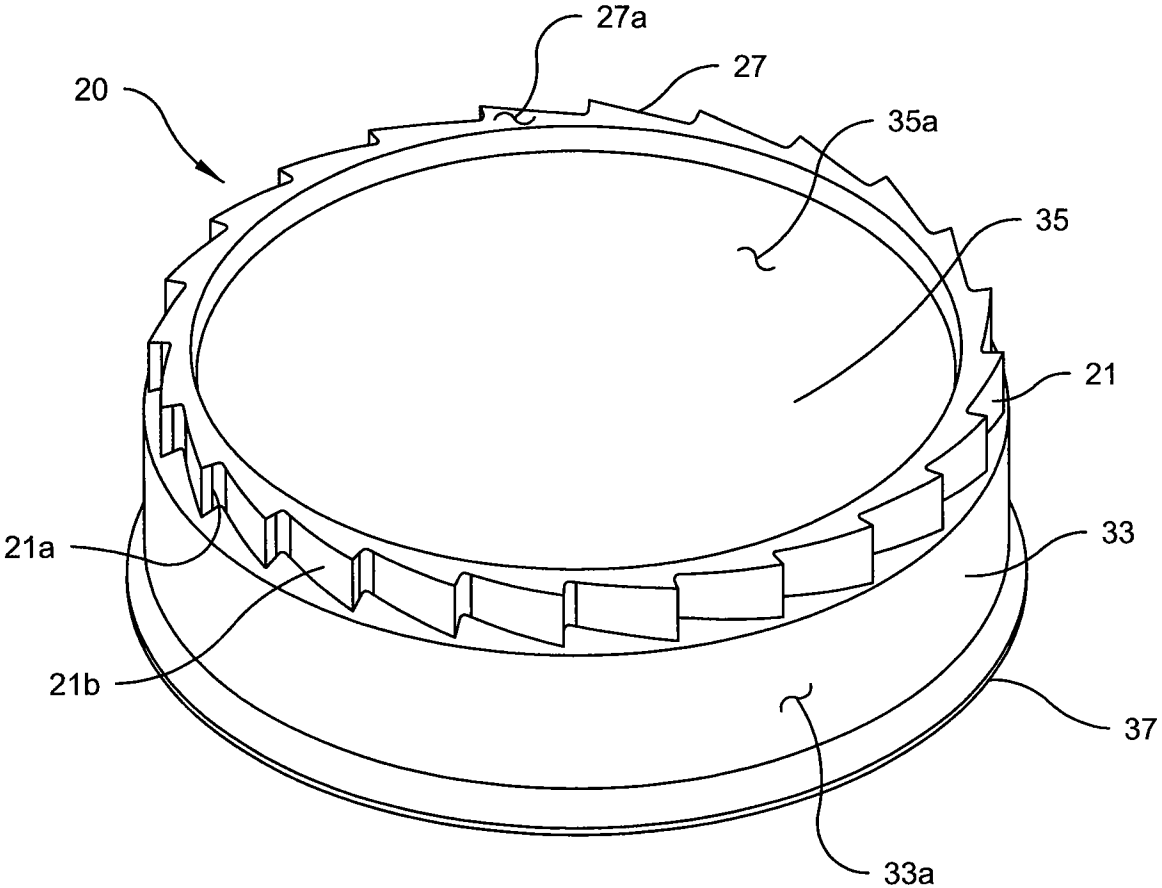
FIG. 4 is a top perspective view of an undercap in accordance with the preferred embodiment.
Figure 5:
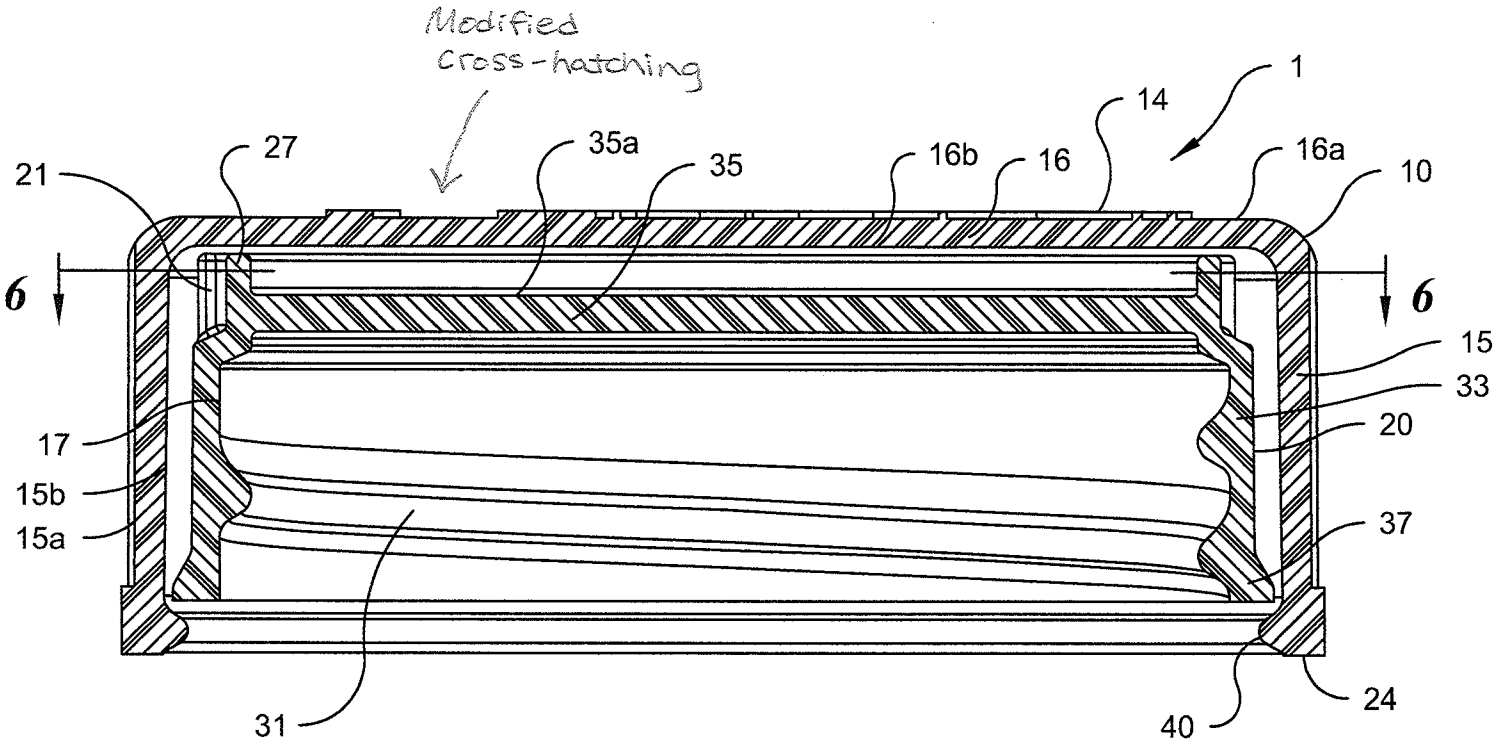
FIG. 5 is a cross section of the undercap of FIG. 4 as installed in the overcap of FIG. 1 taken along the line 5-5 of FIG. 1.
Figure 6:
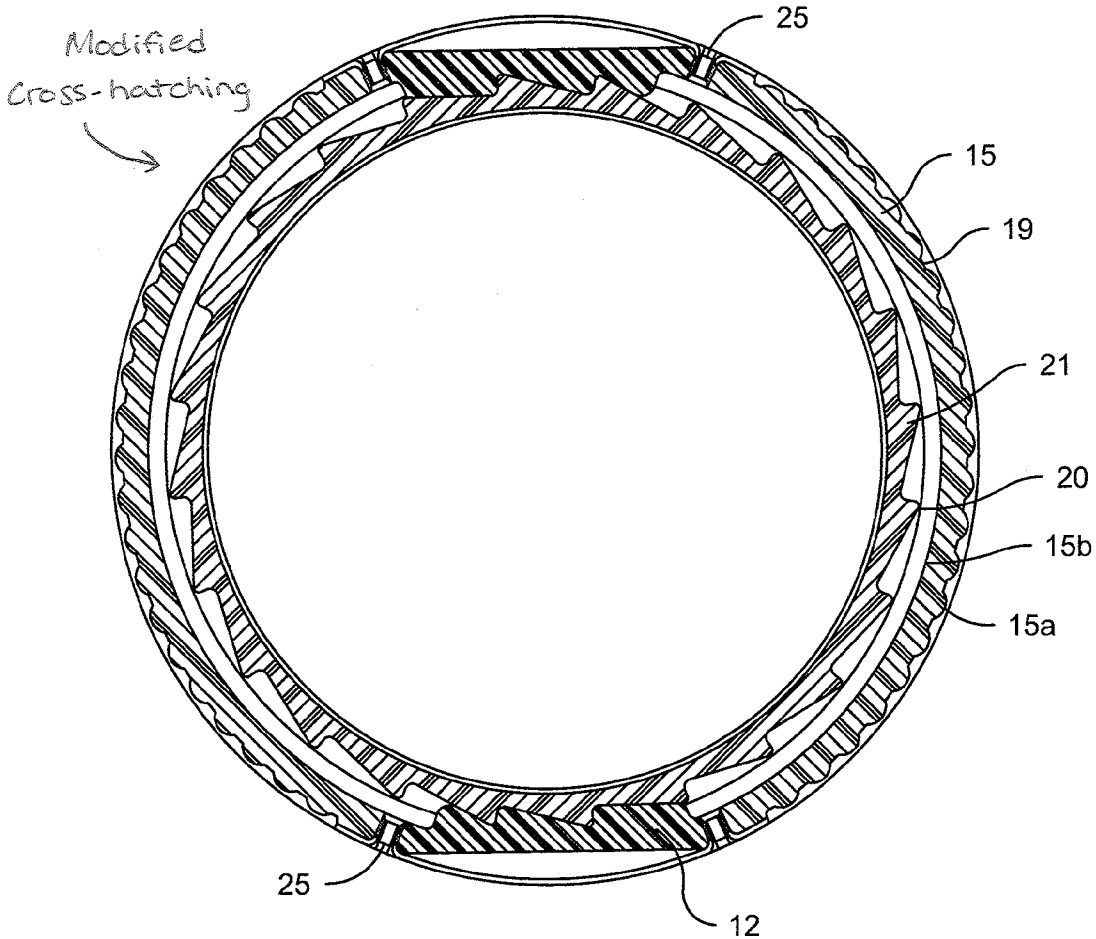
FIG. 6 is a cross section of the undercap of FIG. 4 as installed in the overcap of FIG. 1 taken along the line 6-6 of FIG. 5.

The preferred embodiment of the child resistant closure 1 comprises an outer cap or overcap 10 and an inner cap or undercap 20. Refer now to FIGS. 4-6. In the preferred embodiment, the undercap 20 is a molded, polypropylene, substantially circular, cup shaped part having a top 35, and a depending sidewall 33 surrounding the top 35. An outwardly facing flange 37 is located on a terminal end of the sidewall 33 opposite the top 35. The sidewall 33 has a smooth outer surface 33*a* and a threaded interior surface 17 with threads 31 of a standard SPI container finish (not shown). The sidewall 33 extends upwardly above the top surface 35*a* of the top 35, terminating in a shoulder 27 having a top surface 27*a*.

Preferably, the shoulder 27 includes a plurality of outwardly facing teeth 21 around the periphery of the shoulder 27. Preferably the tips of the outwardly facing teeth 21 are slightly recessed (indented) with respect to the outer surface 33*a* of the sidewall 33. Each one of the outwardly facing teeth 21 has a steeply sloping or generally radial face 21*a* and a gently sloping or generally tangential face 21*b*, the gently sloping face extending generally in a counter-clockwise direction when viewed from the top of the undercap 20. Preferably the gently sloping face 21*b* makes an angle of approximately 97 degrees in respect to a radius drawn from a center point of the shoulder 27, and the steeply sloping face makes an angle of approximately −5 degrees with respect to the radius drawn from the center point of the shoulder 27.

Figure 2:
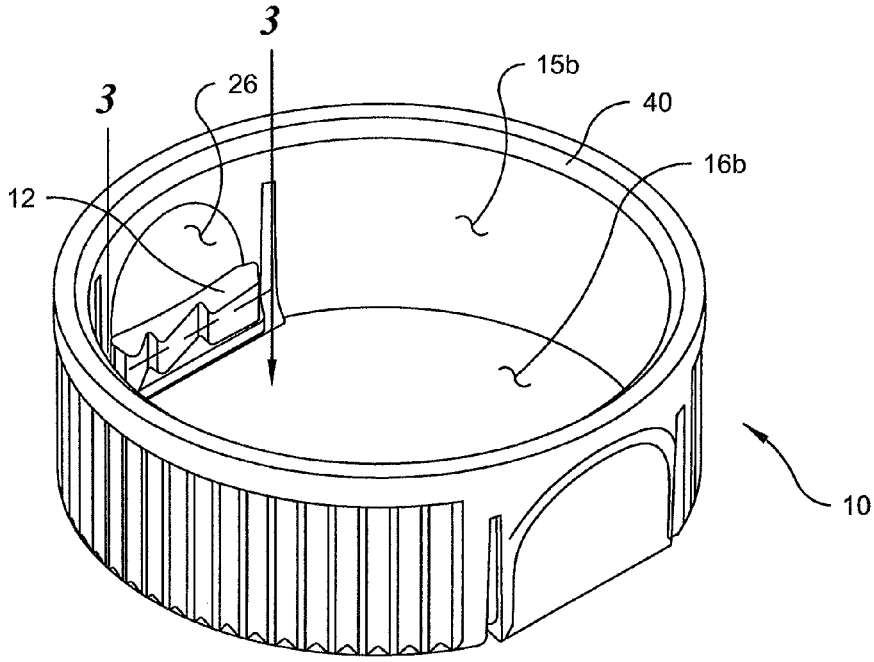
FIG. 2 is a perspective bottom view of the overcap of FIG. 1.

Refer now to FIGS. 1, 2 and 5. In the preferred embodiment of the closure 1, the overcap 10 is a molded, polypropylene, substantially circular, cup-shaped part, having a top wall 16 with an interior surface 16*b*, and an outer surface 16*a* on which is printed or molded, indicia 14, indicating pictorially, a method for removing the closure 1 from a container (not shown) onto which it has been screwed. Depending from the top wall 16 of the overcap 10 is a circumferential sidewall 15 having an outer surface 15*a*, a smooth interior surface 15*b*, a lower edge 24, and at the lower edge 24, an inwardly directed circumferential flange 40. The outer surface 15*a* has, over a portion, a gripping surface 19, such as ribs or knurling.

Included in the sidewall 15 of the preferred embodiment are diametrically opposed tabs 11*a* and 11*b*. Each tab 11*a*, 11*b* is connected to the sidewall 15 of the overcap 10 by a living hinge 13 located proximate to the lower edge 24 of the sidewall 15. Surrounding each tab 11*a*, 11*b*, except at the hinge 13, is a gap 25. The gap 25 allows the tabs 11*a*, 11*b* to pivot on the hinge 13 toward the center of the closure 1 when the tabs 11*a*, 11*b* are squeezed toward each other.

Figure 3:
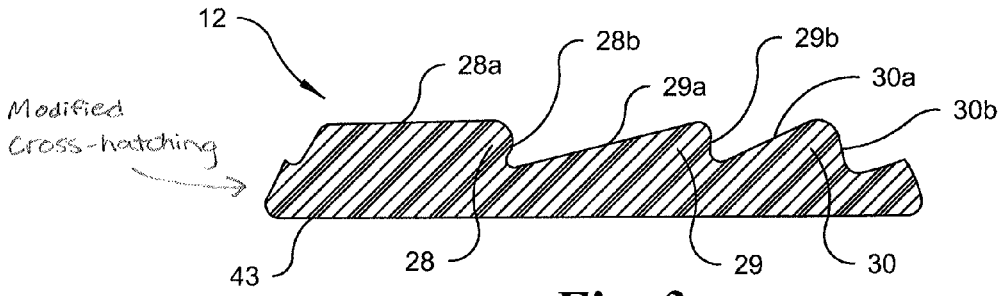
FIG. 3 is a greatly enlarged cross section of the lugs shown FIG. 1, taken along the line 3-3 of FIG. 2.

Refer now to FIGS. 2, 3 and 6. In the preferred embodiment, a lug 12, comprising first, second and third inwardly facing teeth 28, 29 and 30 respectively, and a base 43, is disposed on an inner surface 26 of each tab 11*a*, 11*b*, proximate to an end of each tab 11*a*, 11*b*, opposite to the hinge 13. Preferably, the height of each one of the teeth 28, 29, 30 relative to the base is approximately equal. As shown particularly in FIG. 3, each of the first, second and third inwardly facing teeth 28, 29, 30 has preferably, a gently sloping face 28*a*, 29*a*, 30*a* and a steeply sloping face 28*b*, 29*b*, 30*b*, the slopes of the gently sloping faces 28*a*, 29*a*, 30*a* and the steeply sloping faces 28*b*, 29*b*, 30*b* of at least two and more preferably three of the first, second and third inwardly facing teeth 28, 29, 30 differing respectively one from another. Accordingly, in the preferred embodiment, the first gently sloping face 28*a* makes an angle of approximately −90 degrees in respect to a perpendicular drawn from the base of the lug 12 to the center of the overcap 10, the second gently sloping face 29*a* makes an angle of approximately 75 degrees in respect to a perpendicular drawn from the base of the lug 12 to the center of the overcap 10, and the third gently sloping face 29*c* makes an angle of approximately 60 degrees in respect to a perpendicular drawn from the base of the lug 12 to the center of the overcap 10. Preferably, the first steeply sloping face 28*b* makes an angle of approximately −12 degrees in respect to a perpendicular drawn from the base of the lug 12 to the center of the overcap 10, the second steeply sloping face 29*b* makes an angle of approximately +3 degrees in respect to a perpendicular drawn from the base of the lug 12 to the center of the overcap 10, and the third steeply sloping face 30*b* makes an angle of approximately 18 degrees in respect to a perpendicular drawn from the base of the lug 12 to the center of the overcap 10.

In the preferred embodiment of the closure 1, the undercap 20 is held captive in the overcap 10 by interference of the undercap flange 37 with the overcap flange 40. As shown in FIG. 6, the flange 37 of the undercap 20 abuts the interior surface 15*b* of the of the sidewall 15 of the overcap 10, and the top surface 27*a* of the shoulder 27 abuts the interior surface 16*b* of the top wall 16 of the overcap 10 such that the amount of vertical and lateral clearances provided for the undercap 20 within the overcap 10 result in the undercap 20 being free to rotate and axially fixed in the interior of the overcap 10. Preferably, the steeply sloping faces 21*b* and the gently sloping faces 21*a* of the outwardly facing teeth 21 abut respectively, at least two of the steeply sloping faces 28*b*, 29*b*, 30*b* and the gently sloping faces 28*a*, 29*a*, 30*a* of the inwardly facing teeth 12 when the undercap 20 is held captive in the overcap 10. Preferably, two of the inwardly facing teeth 28, 29, 30 of the lug 12 completely engage two of the outwardly facing teeth 21 of the undercap 20.

In the preferred embodiment, the closure 1 is attached to a container by applying a clockwise force to the overcap 10 when viewed from the top. The clockwise force causes the second and third steeply sloping faces 29*b*, 30*b* of the second and third inwardly facing teeth 29, 30 to contact two of the steeply sloping faces 21*b* of the outwardly facing teeth 21, allowing the closure 1 to be firmly attached to the finish of the container without having to squeeze the tabs 11*a*, 11*b*.

The closure 1 is removable from the container on which it has been firmly attached when a force between the depending sidewall 15 of the overcap 10 and the undercap 20 exceeds a frictional force between the closure 1 and the container. In the preferred embodiment, the force is created by applying a force in the counter-clockwise direction to the overcap 10, while simultaneously squeezing the tabs 11*a*, 11*b* with a force of sufficient magnitude such that at least two of the first, second and third gently sloping faces 28*a*, 29*a*, 30*a* maintain contact with at least two of the gently sloping faces 21*b* of the opposing outwardly facing teeth 21 during rotation. If, when rotating the overcap 10 in the counter clockwise direction, insufficient squeezing force is applied to the tabs 11*a*, 11*b* to overcome the frictional force of a screwed-on closure 1, the tabs 11*a*, 11*b* flex outwardly and the first, second and third inwardly facing teeth 28, 29, 30 ride over the outwardly facing teeth 21, and make a clicking sound providing feedback to the user to provide additional squeezing force to the tabs 11*a*, 11*b*.

While it is preferred that the outwardly facing teeth 21 of the undercap 20 be disposed on the outer periphery of the shoulder 27, the outwardly facing teeth 21 may also be located at any location around the periphery of the sidewall 33.

While it is preferred that the tabs 11*a*, 11*b* be connected to the sidewall 15 by a living hinge, the tabs 11*a*, 11*b* need not be hinged but merely be capable of being flexed inwardly such that the outercap 10 and the inner cap 20 engage as described above. Also, while it is preferred that the outercap 10 have diametrically opposed tabs 11*a*, 11*b*, the outercap may have only a single tab 11*a*, or no tabs 11*a*, 11*b* (not shown). Thus, while it is preferred that the lugs 12 are disposed on the inner surface 26 of each of the tabs 11*a*, 11*b*, the lugs 12 may be disposed on only one of the tabs 11*a*, where the second tab 11*b* has only a smooth face opposing the outwardly facing teeth 21. Further, in the case where there are no tabs 11*a*, 11*b*, the lugs 12 may be disposed directly on the interior surface 15*b* of the sidewall 15 and the functions of the tabs 11*a*, 11*b*, as described below, are subsumed by the outercap 10 by making the outercap 10 of a flexible material.

While it is preferred that each one of the lugs 12 has three inwardly facing teeth 28, 29, 30 there may be more or less than three inwardly facing teeth 28, 29, 30 and the slopes of the inwardly facing teeth 28, 29 need not all be different. Accordingly, while it is preferred that two inwardly facing teeth 28, 29, 30 mate with the outwardly facing teeth 21 when the closure is being attached and being released from a container, more or less inwardly facing teeth 28, 29, 30 may mate with the outwardly facing teeth 21 depending on the number of inwardly facing teeth 28, 29, 30 included with each lug 12.

While it is preferred that each lug 12 is disposed proximate to the end of a tab 11*a*, 11*b*, each lug 12 need not be disposed proximate to the end of a tab 11*a*, 11*b*, but may be disposed at a location on the inner surface 26 of a tab 11*a*, 11*b* which corresponds to the location of the outwardly facing teeth 21 on the undercap 20.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A closure comprising:

a cup shaped outer cap having a top wall and a depending sidewall, said sidewall being provided with a lug having a plurality of inwardly facing teeth, each one of the plurality of inwardly facing teeth having a gently sloping face and a steeply sloping face, the slopes of the gently sloping faces and the steeply sloping faces of at least two of the plurality of inwardly facing teeth differing respectively one from another; and a cup shaped inner cap having a top wall and depending sidewall, said sidewall being provided with a plurality of outwardly facing teeth around a periphery thereof, the outwardly facing teeth being arranged on a shoulder extending upwardly from the sidewall of the inner cap, each one of the outwardly facing teeth having a steeply sloping face and a gently sloping face, said inner cap being rotatably fit and axially fixed in an interior of the outer cap, the steeply sloping faces and the gently sloping faces of the outwardly facing teeth being adapted to abut, respectively, the at least two steeply sloping faces and gently sloping faces of the inwardly facing teeth.

2. The closure of claim 1, wherein the sidewall of the outer cap includes at least one tab, and the lug is disposed on an inner surface of the at least one tab.

3. The closure of claim 2, wherein the at least one tab is capable of being inwardly pivoted.

4. The closure of claim 3, wherein the at least one tab is hinged to the sidewall.

5. The closure of claim 2, wherein the at least one tab comprises two tabs diametrically opposed on the depending sidewall of the outer cap.

6. The closure of claim 5, wherein the lug is disposed on one of the diametrically opposed tabs.

7. The closure of claim 1, wherein the plurality of inwardly facing teeth of the lug comprises three inwardly facing teeth.

8. The closure of claim 7, wherein the plurality of outwardly facing teeth of the inner cap comprises three outwardly facing teeth, and wherein the gently sloping faces of the three inwardly facing teeth of the outer cap abut the gently sloping faces of the three outwardly facing teeth of the inner cap.

9. The closure of claim 8, wherein the two inwardly facing teeth of the outer cap completely engage two of the three outwardly facing teeth of the inner cap.

10. The closure of claim 1, wherein a clockwise force applied to the outer cap causes two of the steeply sloping faces of the inwardly facing teeth to contact two of the steeply sloping faces of the outwardly facing teeth, allowing the closure to be firmly attached to the container without having to apply a radial force to the sidewall of the closure.

11. The closure of claim 1, wherein the closure is removable from a container on which the closure has been firmly screwed by applying a force in a counter-clockwise direction to the outer cap while simultaneously squeezing the sidewall of the outer cap with a force of sufficient magnitude such that at least two of the gently sloping faces of the inwardly facing teeth maintain contact with at least two of the gently sloping faces of the opposing outwardly facing teeth during rotation of the closure, and wherein, if when rotating the outer cap in the counter-clockwise direction, insufficient squeezing force is applied to the sidewall of the outer cap to overcome the frictional force of the screwed-on closure, the inwardly facing teeth ride over the outwardly facing teeth and make a clicking sound.

12. A two piece child-resistant closure comprising:

a closed end cylindrical outer cap having a top wall and a depending sidewall, said sidewall being provided with a lug having a plurality of inwardly facing teeth, each one of the plurality of inwardly facing teeth having a gently sloping face and a steeply sloping face, the slopes of the gently sloping faces and the steeply sloping faces of at least two of the plurality of inwardly facing teeth differing respectively one from another, at least one tab pivotally attached to the sidewall of the outer cap proximate a lower edge thereof; and a closed end cylindrical inner cap having a top wall and depending sidewall, said sidewall being provided with a plurality of outwardly facing teeth around its periphery, each one of the outwardly facing teeth having a steeply sloping face and a gently sloping face, said inner cap being rotatably fit and axially fixed in an interior of the inner cap, the steeply sloping faces and the gently sloping faces of the outwardly facing teeth being adapted to abut, respectively, the at least two steeply sloping faces and gently sloping faces of the inwardly facing teeth.

* * * * *